US008596153B2

(12) United States Patent
Arenz

(10) Patent No.: US 8,596,153 B2
(45) Date of Patent: Dec. 3, 2013

(54) DRIVE DEVICE

(75) Inventor: Bernd Arenz, Herschbroich (DE)

(73) Assignee: Stabilus GmbH, Koblenz (DE)

( * ) Notice: Subject to any disclaimer, the term of this patent is extended or adjusted under 35 U.S.C. 154(b) by 1326 days.

(21) Appl. No.: 12/290,990

(22) Filed: Nov. 5, 2008

(65) Prior Publication Data

US 2009/0113803 A1 May 7, 2009

(30) Foreign Application Priority Data

Nov. 7, 2007 (DE) ..... 10 2007 053 452

(51) Int. Cl.
*F16H 27/02* (2006.01)
*E05F 11/00* (2006.01)
*E05F 15/10* (2006.01)

(52) U.S. Cl.
USPC ..... 74/89.23; 49/337; 49/340

(58) Field of Classification Search
USPC ..... 74/89.23, 89.36, 89.37, 89.39, 89.4, 74/89.41, 89.45, 502.4, 502.6; 296/56, 296/100.1, 106, 146.8; 49/333, 334, 337, 49/339, 340
See application file for complete search history.

(56) References Cited

U.S. PATENT DOCUMENTS 4,148,235 A * 4/1979 Gerth ..... 82/132
7,234,757 B2 * 6/2007 Mitchell ..... 296/146.8
7,481,126 B2 * 1/2009 Las Navas Garcia ..... 74/89.23
7,506,556 B2 * 3/2009 Ritter et al. ..... 74/89.2

* cited by examiner

*Primary Examiner* — Thomas R Hannon
*Assistant Examiner* — Adam D Rogers
(74) *Attorney, Agent, or Firm* — Cozen O'Connor

(57) ABSTRACT

Disclosed is a drive device for the automatic opening and closing of hinged lids, especially motor vehicle lids. The drive device includes a housing, a rotary drive installed in the housing, at least one spindle drive, which can be driven by the rotary drive and which comprises a threaded spindle and a spindle nut, a connecting device mounted on the spindle nut, and at least one actuating pull, comprising a cable and a sleeve, where one end of the cable is attached to the connecting device.

15 Claims, 9 Drawing Sheets

View A

View A

DRIVE DEVICE

BACKGROUND OF THE INVENTION

1. Field of the Invention

The invention pertains to a drive device for the automatic opening and closing of lids, especially hinged motor vehicle lids.

2. Description of the Related Art

Many different types of drive devices for driving movable components such as engine compartment hoods, doors, trunk lids, or the hatchback tailgates of motor vehicles are known. A new drive device must be designed every time the body and the component that moves relative to the body are redesigned.

SUMMARY OF THE INVENTION

The present invention relates to a simple and compact drive device that does not have to be designed every time the body and the component that moves relative to the body are redesigned.

According to one embodiment of the invention, the drive device comprises a housing, a rotary drive installed in the housing, at least one spindle drive driven by the rotary drive, which comprises a threaded spindle and a spindle nut, a connecting device mounted on the spindle nut, and at least one actuating pull, comprising a cable and a sleeve, wherein one end of the cable is attached to the connecting device.

In a preferred embodiment, the cable is connected to a connecting device comprising a U-shaped web.

To connect the cable to the web, the cable is preferably provided with a stiff endpiece, that has an area of reduced diameter. The area with the reduced diameter is inserted into the web.

In one embodiment of the drive device, the housing comprises a cover with a retaining device, to which one end of the sleeve of the actuating pull is attached.

The actuating pull is easily installed because the connecting device projects from the cover through a slot extending in the axial direction.

In one embodiment, the slot is at least partially covered by a first safety device so that the cable of the actuating pull cannot disengage from the connecting device. The first safety device is preferably an integral part of the cover.

In one embodiment, after the cable of the actuating pull has been hooked onto the connecting device and the sleeve of the actuating pull has been hooked onto the retaining device in the cover provided for it a second safety device covers the portion of the slot not covered by the first safety device.

The drive device is easily assembled, because the second safety device can be pushed onto the cover in the radial direction.

In one embodiment, the hinged lid is moved without twisting by several spindle drives arranged parallel to each other, each of which drives an actuating pull hinged to one side of the lid. In this case, one spindle drive is preferably coaxial to the rotary drive and at least one spindle drive is axially parallel to the rotary drive.

In one embodiment, the actuating pull comprises a push-pull cable.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are illustrated in the drawing and are described in greater detail. Elements that respectively correspond to one another are provided with the same reference signs in all the figures. In the drawings.

DETAILED DESCRIPTION OF THE PRESENTLY PREFERRED EMBODIMENTS

Figure 1:
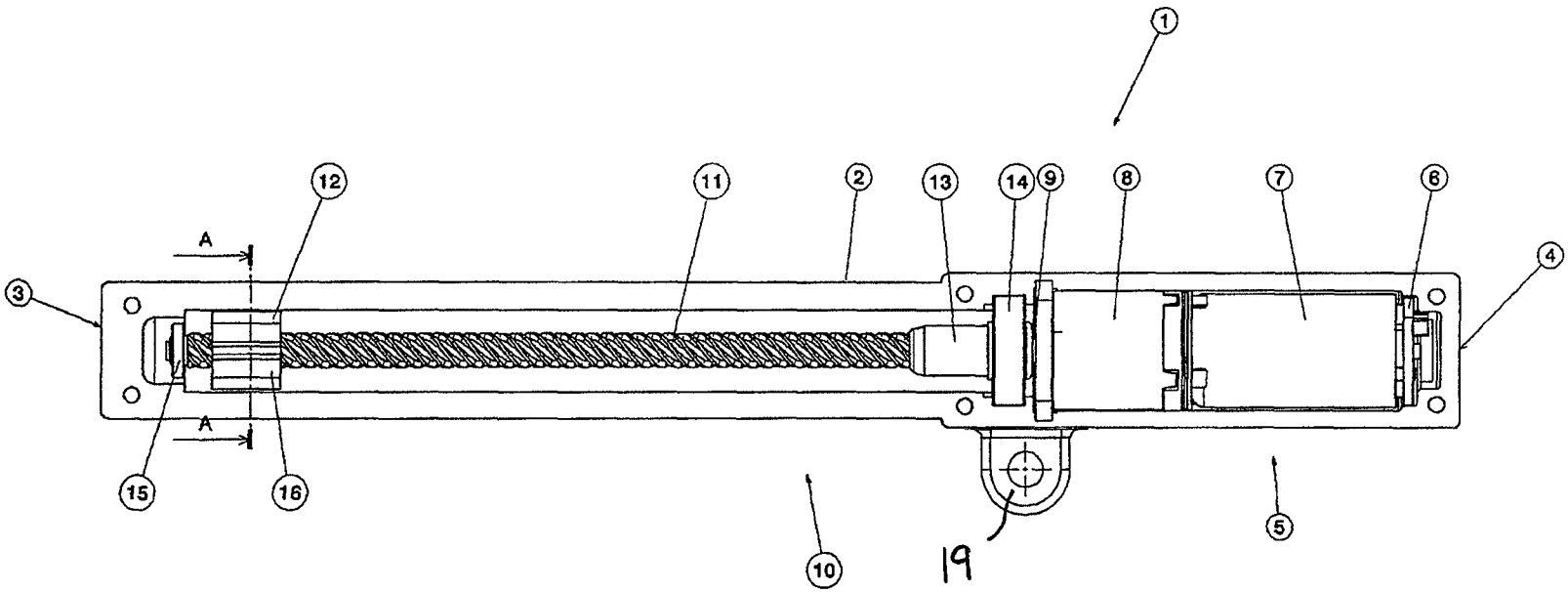
FIG. 1 shows a first embodiment of the invention with an opened housing.
Figure 1A:
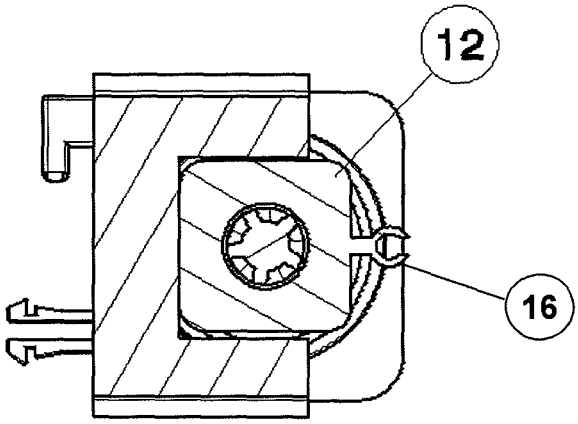
FIG. 1A is a cross-sectional view of the drive device having a connecting device 16 with a U-shaped web.

FIG. 1 shows a first embodiment of a drive device 1 for the automatic opening and closing of movable components (not shown) such as engine compartment hoods, doors, trunk lids, hatchback tailgates, or the like on motor vehicles. For the sake of simplicity, these are referred to below simply as hinged lids.

In one embodiment, the drive device 1 preferably has an elongated, tub-like housing 2 with a first end 3 and a second end 4, in which a rotary drive 5 is installed. The rotary drive 5 comprises a sensor device 6 near the second end 4, a motor 7 adjacent to the sensor device 6, and a gear unit 8, driven by a drive shaft (not shown). In one embodiment, the rotary drive 5 includes a clutch (not shown), which, for example, would be located between the motor 7 and the gear unit 8 or downline from the gear unit.

A gear shaft 9 extends from the side of the gear unit 8 opposite the second end 4 and is connected to the spindle drive 10. The spindle drive 10 comprises a threaded spindle 11, on which a spindle nut 12 is able to move axially in the direction toward either the first end 3 or the second end 4. The threaded spindle 11 is retained on the gear shaft 9 by a crimp sleeve 13. The crimp sleeve 13 is supported in a roller bearing 14 and thus held in place in the axial direction. The roller bearing 14 is preferably dimensioned to absorb axial forces. A disk-like end stop 15 is provided on the end of the threaded spindle 11 near the first end 3 to limit the axial movement of the spindle nut 12 in the direction toward the first end 3.

Figure 5:
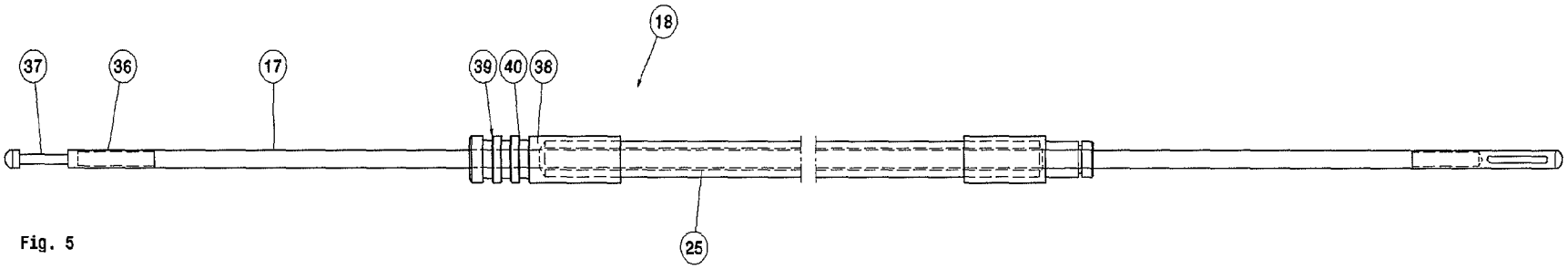
FIG. 5 shows an actuating pull.

The spindle nut 12 is preferably square but any polygon can be used. The edges and corners of spindle nut 12 are preferably rounded to prevent jamming. It should be noted that the shape of the spindle nut 12 preferably matches the shape of the housing 2. The interior space of the housing 2, in which the spindle drive 10 is installed, substantially corresponds to the dimensions of the spindle nut 12, so that the spindle nut 12 can slide along the walls of housing 2 without turning. The spindle nut 12 comprises a connecting device 16, onto which a cable 17 of an actuating pull 18, as shown in FIG. 5, can be hooked. The actuating pull 18 is preferably designed as a push-pull cable and the cable preferably include a sheath.

The interior space of the housing 2 is designed so that different inside diameters are obtained. For example, the rotary drive 5 or the roller bearing 14 can be installed with only slight play or no play in the housing 2. Connecting elements 19 are preferably formed on the housing 2 so that the drive device 1 is attached to the stationary component such as the body of a motor vehicle or to a movable component such as the hinged lids on a motor vehicle. In one embodiment, threaded bores or the like are provided in the housing 2 as connecting elements.

Figure 2A:
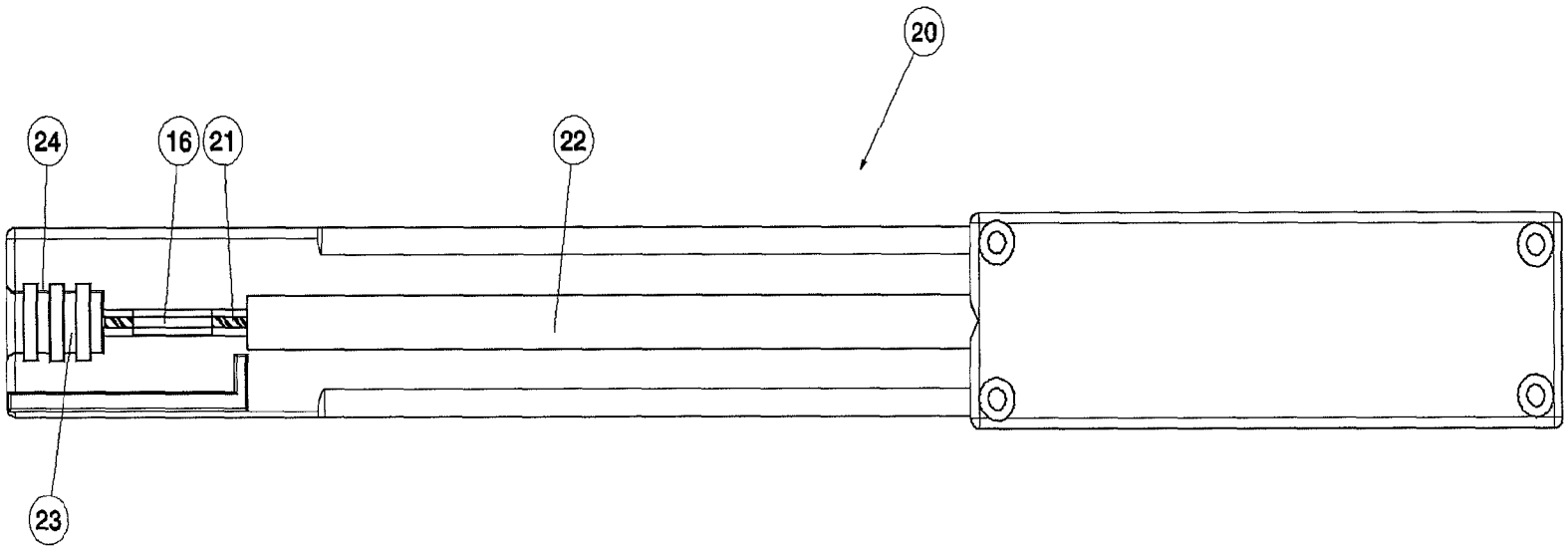
FIGS. 2*a* and 2*b* show a cover for the embodiment according to FIG. 1.
Figure 2B:
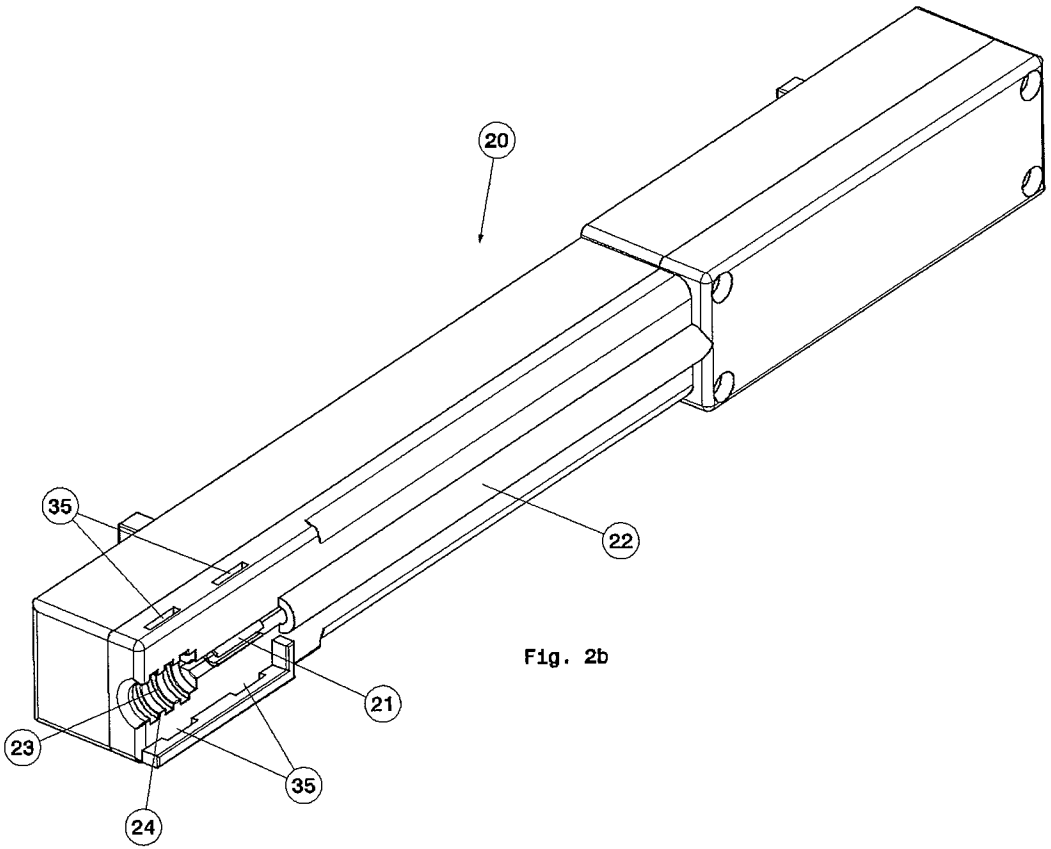

FIGS. 2*a* and 2*b* show a cover 20 configured to close the housing 2 of the drive device 1. The area of the cover, which covers the spindle drive 10, has a slot 21. The connecting device 16, onto which the cable 17 of the actuating pull 18 shown in FIG. 5 is attached, projects through the slot 21. To prevent cable 17 from coming loose from the connecting device 16, the slot 21 is preferably at least partially covered by an arch-like first safety device 22. The first safety device 22 is preferably an integral part of the cover 20.

At the end of the slot 21, facing the first end 3, the slot merges with a retaining device 23. In one embodiment, retaining device 23 is a hollow cylinder-like component with retaining ribs 24. A sleeve 25 of the actuating pull 18 shown in FIG. 5 is inserted into the retaining device 23. One end of the pull 18 has a shape complementary to the retaining device 23.

Figure 4A:
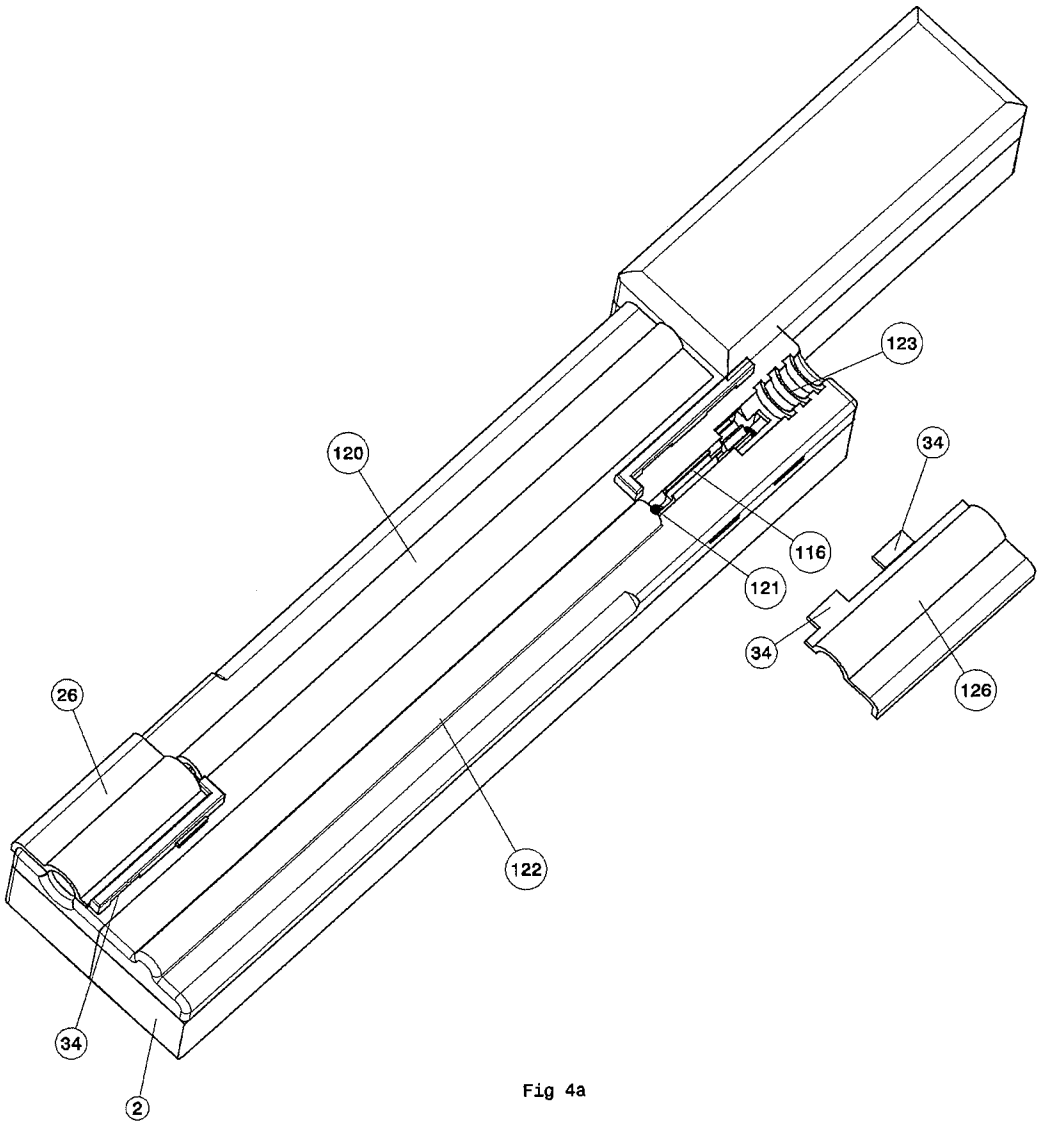
FIGS. 4*a* and 4*b* show the embodiment according to FIG. 3 with a closed housing.
Figure 4B:
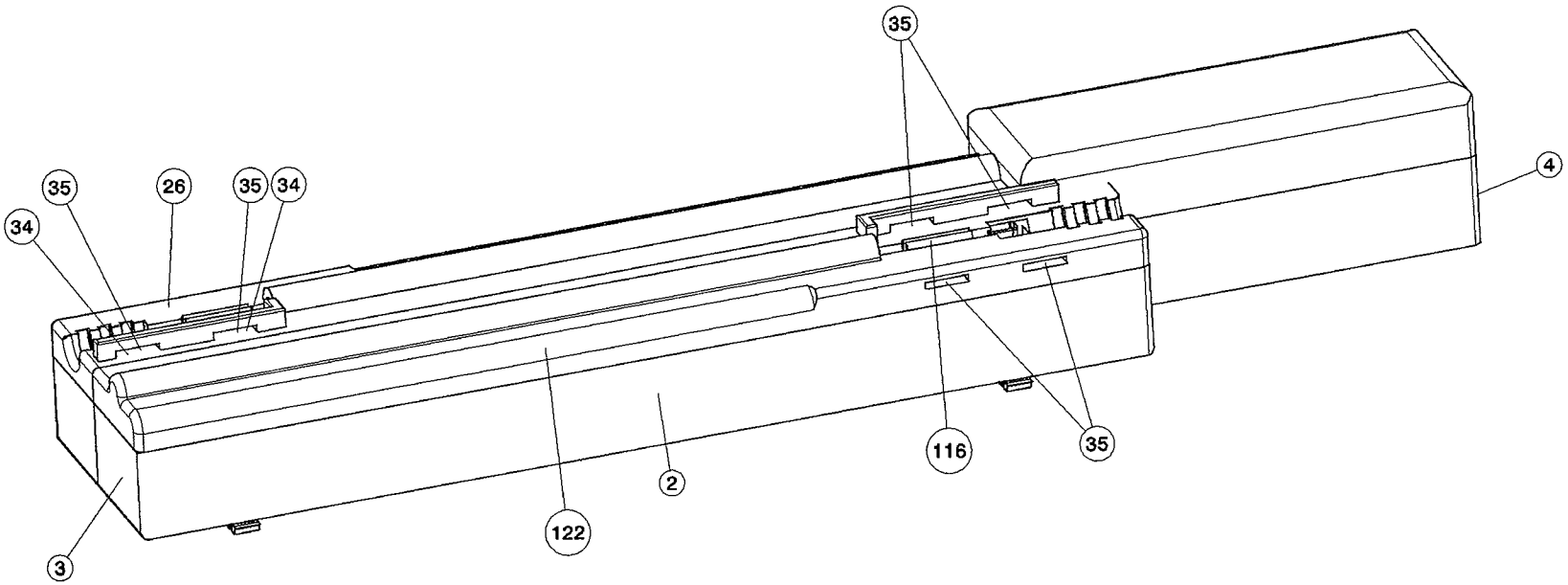

The portion of slot 21 not covered by safety device 22 is preferably covered by a second safety device 26, shown in FIGS. 4*a* and 4*b*. Safety device 22 is installed after the cable 17 of the actuating pull 18 has been hooked onto the connecting device 16 and the sleeve 25 of the actuating pull 18 has been hooked onto the retaining device 23 in the cover provided for it. The second safety device 26 also preferably has the contour of a hollow cylinder that partially surrounds the sleeve 25 of the actuating pull 18. The second safety device 26 comprises fastening elements 34, which fit into recesses 35 formed in the cover 20.

Typically, the actuating pull 18 is securely connected to the drive device 1 after the cable 17 has been inserted into the connecting device 16, the housing has been closed by the cover 20, the sleeve 25 has been inserted into the retaining device 23, and after the second safety device 26 has been attached to the cover. The other end of the actuating pull is then connected to the movable component. While the preferred order for assembly is disclosed, other orders for assembly are possible.

Figure 3A:
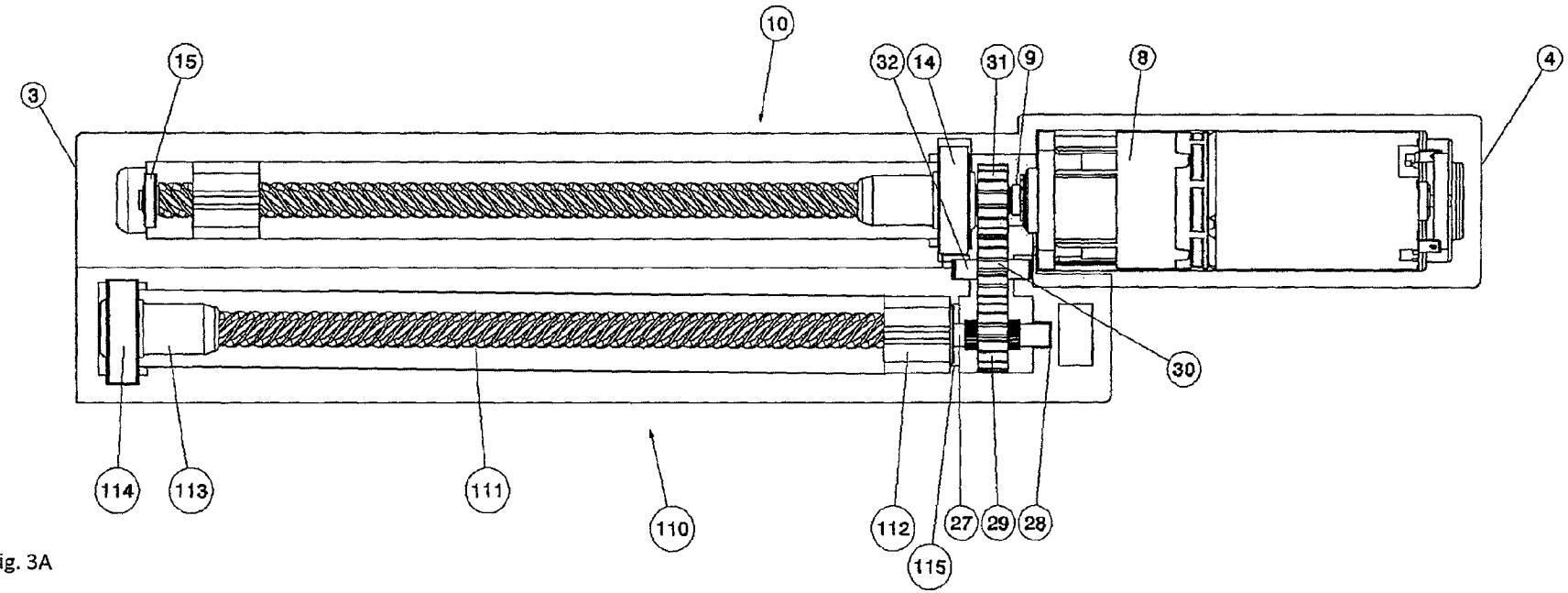
FIGS. 3A and 3B show embodiments of the invention with an opened housing.

FIG. 3A shows another embodiment of the invention. An additional spindle drive 110 is arranged parallel to the spindle drive 10. A roller bearing 114 is placed near the first end 3 of the housing 2. The threaded spindle 111 is supported by a crimp sleeve 113 in the roller bearing 114 and thus held in place in the axial direction. The dimensions of the roller bearing 114 are preferably such that it can also absorb axial forces. A spindle nut 112, which corresponds to the spindle nut 12 described in conjunction with FIG. 1 and which therefore requires no further explanation, is mounted on the threaded spindle 111.

Figure 3B:
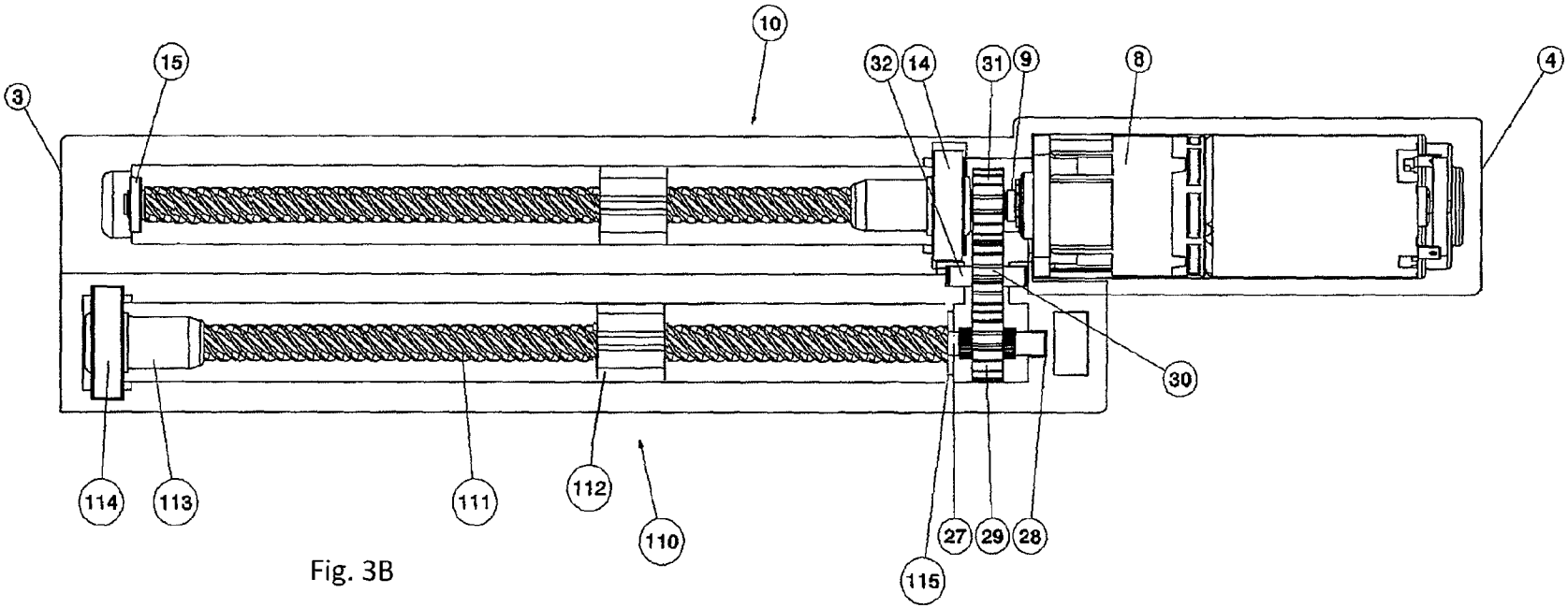

FIG. 3B shows another embodiment of the invention like FIG. 3B except that the spindle nut and the second spindle nut are configured to move in a same direction.

A journal 27 is formed on the end of the threaded spindle 111 opposite the first end 3. Journal 27 is supported in a plain bearing bush 28. In one embodiment of the invention, a corresponding recess in the housing wall forms the plain bearing bush 28. A first gear wheel 29, which meshes with a second gear wheel 30, is mounted on the journal 27. The second gear wheel 30, which is mounted on the gear shaft 9 between the gear unit 8 and the roller bearing 14, meshes in turn with a third gear wheel 31. The first gear wheel 29 and the third gear wheel 31 are preferably held in place on the journal 27 and the gear shaft, respectively, by teeth. Other positive or non-positive types of connections, however, are also possible. A bearing shaft 32 passes through the second gear wheel 30. Shaft 32 rotatably supports the second gear wheel 30 in the housing wall between the first gear wheel 29 and the third gear wheel 31. The thread of the threaded spindle 11 turns in the opposite direction to that of the threaded spindle 111. The spindle nuts 12 and 112 therefore always move in opposite directions in order to transmit equal forces to the hinged lid, so that the lid does not twist as it is being moved. In one embodiment, only the gear wheels 29 and 31 are provided and the threads of the threaded spindles 11 and 111 turn in the same direction.

An end stop for the spindle nut 112 is provided by a projection 33 on the inside surface of the housing wall.

FIGS. 4*a* and 4*b* depict the drive device described in conjunction with FIG. 3 with a closed cover 120. The areas of the cover, which cover the spindle drive 10, are not described in detail, because they correspond to the design explained in conjunction with FIG. 2.

The area of the cover, which covers the spindle drive 110, has a slot 121. The connecting device 116, onto which the cable 17 of the actuating pull 18 shown in FIG. 5 is hooked, projects through the slot 121. The slot 121 is at least partially covered by an arch-like first safety device 122, which is preferably an integral part of the cover 120.

At the end of the slot 121 closer to the second end 4, the slot merges with a retaining device 123. The retaining device 123 comprises the same structure as that described on the basis of the retaining device 23. The sleeve 25 of the actuating pull shown in FIG. 5 is inserted into the retaining device 123. The end of the actuating pull has a shape, which is complementary to that of the retaining device 123.

The area of the slot 121 not covered by the first safety device 122 is covered by a second safety device 126, after the cable 17 of the actuating pull 18 has been hooked onto the connecting device 116 and the sleeve 25 of the actuating pull 18 has been hooked onto the retaining device 123 provided for it in the cover. The second safety device 126 has the contour of a hollow cylinder, which partially surrounds the sleeve 25 of the actuating cable 18. The second safety device 126 also comprises several fastening elements 34. The fastening elements 34 fit into recesses 35 which are formed in the cover 120 and make it possible for the second safety device 126 to be fastened to the cover 120. The second safety device 26 is attached to the cover 20, 120 in the same way.

The locking of the second safety device 126 to the cover 120 substantially ensures that the sleeve 25 and the cable 17 are held securely in the drive device 101.

FIG. 5 depicts the actuating pull typically in the form of a push-pull cable. The push-pull cable comprises a cable 17 and a sleeve 25 that surrounds the cable. The cable 17 is provided with a stiff endpiece 36, which has an area 37 of reduced diameter. After the cover 20 or 120 has been attached to the housing 2, this area 37 is inserted into the U-shaped web of the connecting device 16, as a result of which the cable 17 is held in place in the axial direction.

The end of the sleeve 25 near the endpiece 36 has an endpiece 38, in which a section 39 of reduced diameter is formed, but which also comprises several ribs 40. The ribs 40 cooperate with the retaining ribs 24 of the retaining device 23, so that the sleeve 25 is held in place in the axial direction. The ends of the actuating pull 18 opposite the endpiece 36 and the endpiece 38 are connected to suitable connecting means on the hinged lid.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A drive device for opening and closing hinged motor vehicle lids, comprising:

a housing;

a rotary drive mounted in the housing;

a first spindle drive coupled to the rotary drive, the first spindle drive comprising:

a threaded spindle; and a first spindle nut;

a connecting device mounted on the first spindle nut; and an actuating pull, the actuating pull comprising a cable and a sleeve, wherein a first end of the cable is attached to the connecting device, and wherein the connecting device is a U-shaped web.

2. The drive device for opening and closing hinged motor vehicle lids according to claim 1, wherein the actuating pull is configured as a push-pull cable.

3. The drive device for opening and closing hinged motor vehicle lids according to claim 1, wherein the cable further comprises an endpiece having an area of reduced diameter, where the area of reduced diameter is adapted to be inserted into the connecting device.

4. The drive device for opening and closing hinged motor vehicle lids according to claim 1, further comprising a second spindle drive coupled to the rotary drive, the second spindle drive comprising:

a second threaded spindle;

a second spindle nut; and a connecting device mounted on the first spindle nut, wherein the spindle drives are parallel to each other.

5. The drive device for opening and closing hinged motor vehicle lids according to claim 4, wherein at least one of the spindle drives is arranged coaxially to the rotary drive.

6. The drive device for opening and closing hinged motor vehicle lids according to claim 4, wherein at least one of the spindle drives is arranged axially parallel to the rotary drive.

7. The drive device for opening and closing hinged motor vehicle lids according to claim 4, further comprising a drive assembly coupling the first spindle drive to the second spindle drive.

8. The drive device for opening and closing hinged motor vehicle lids according to claim 7, wherein the drive assembly comprises a first gear mounted coaxially with the first spindle drive;

a second gear mounted coaxially with the second spindle drive; and a third gear coupling the first gear to the second gear.

9. The drive device for opening and closing hinged motor vehicle lids according to claim 8, wherein the first spindle nut and the second spindle nut are configured to move in opposite directions.

10. The drive device for opening and closing hinged motor vehicle lids according to claim 7, wherein the first spindle nut and the second spindle nut are configured to move in a same direction.

11. A drive device for opening and closing hinged motor vehicle lids, comprising:

a housing including:

a cover; and a retaining device;

a rotary drive mounted in the housing;

a first spindle drive coupled to the rotary drive, the first spindle drive comprising:

a threaded spindle; and a first spindle nut;

a connecting device mounted on the first spindle nut; and an actuating pull, the actuating pull comprising a cable and a sleeve, wherein a first end of the cable is attached to the connecting device, wherein a first end of the sleeve of the actuating pull is attached to the retaining device, and wherein the cover has a slot extending in an axial direction, wherein the connecting device projects out of the cover through the slot.

12. The drive device for opening and closing hinged motor vehicle lids according to claim 11, wherein the slot is at least partially covered by a first safety device.

13. The drive device for opening and closing hinged motor vehicle lids according to claim 12, wherein the first safety device is an integral part of the cover.

14. The drive device for opening and closing hinged motor vehicle lids according to claim 12, further comprising a second safety device adapted to cover a part of the slot not covered by the first safety device.

15. The drive device for opening and closing hinged motor vehicle lids according to claim 14, wherein the second safety device is configured to be placed radially onto the cover.

* * * * *